US005178563A

United States Patent [19]

Reed

[11] Patent Number: 5,178,563

[45] Date of Patent: Jan. 12, 1993

[54] CONTACT ASSEMBLY AND METHOD FOR MAKING SAME

[75] Inventor: Carl G. Reed, Clemmons, N.C.

[73] Assignee: AMP Incorporated, Harrisburg, Pa.

[21] Appl. No.: 881,572

[22] Filed: May 12, 1992

[51] Int. Cl.[5] ..... H01R 13/00

[52] U.S. Cl. ..... 439/676; 439/736

[58] Field of Search ..... 439/660, 676, 695, 701, 439/709, 712, 713, 724, 736

[56] References Cited

U.S. PATENT DOCUMENTS

| | | | |
|---|---|---|---|
| 4,186,988 | 2/1980 | Kobler | 439/676 |
| 4,202,593 | 5/1980 | Abernethy et al. | 339/125 R |
| 4,231,628 | 11/1980 | Hughes et al. | 339/17 |
| 4,297,529 | 10/1981 | Webb | 439/676 |
| 4,337,574 | 7/1982 | Hughes et al. | 29/883 |
| 4,541,174 | 9/1985 | Liburdi | 29/883 |
| 4,618,207 | 10/1986 | Silbernagel | 339/176 M |
| 4,698,025 | 10/1987 | Silbernagel et al. | 439/79 |
| 4,699,443 | 10/1987 | Goodrich et al. | 439/188 |
| 4,699,595 | 10/1987 | Nakazawa et al. | 439/676 |
| 4,703,991 | 11/1987 | Philippson | 439/676 |
| 4,786,259 | 11/1988 | Paul | 439/344 |
| 4,806,117 | 2/1989 | Johnston | 439/344 |
| 4,817,283 | 4/1989 | Johnston et al. | 29/884 |
| 4,904,209 | 2/1990 | Nelson | 439/676 |
| 4,992,055 | 2/1991 | Brummans et al. | 439/78 |

*Primary Examiner*—Joseph H. McGlynn
*Attorney, Agent, or Firm*—David L. Smith

[57] ABSTRACT

A contact assembly for a modular receptacle includes an array of substantially coplanar contacts which are held in position by first and second insulators. The contacts are exposed between the two insulators, and a latch mechanism holds the two insulators in the desired transversely oriented relationship with respect to one another. This contact assembly can be formed by insert molding the insulators around the contacts in a substantially coplanar configuration, and then bending the exposed central portions of the contacts to latch the two insulators into the final transverse orientation.

23 Claims, 8 Drawing Sheets

Figure 1
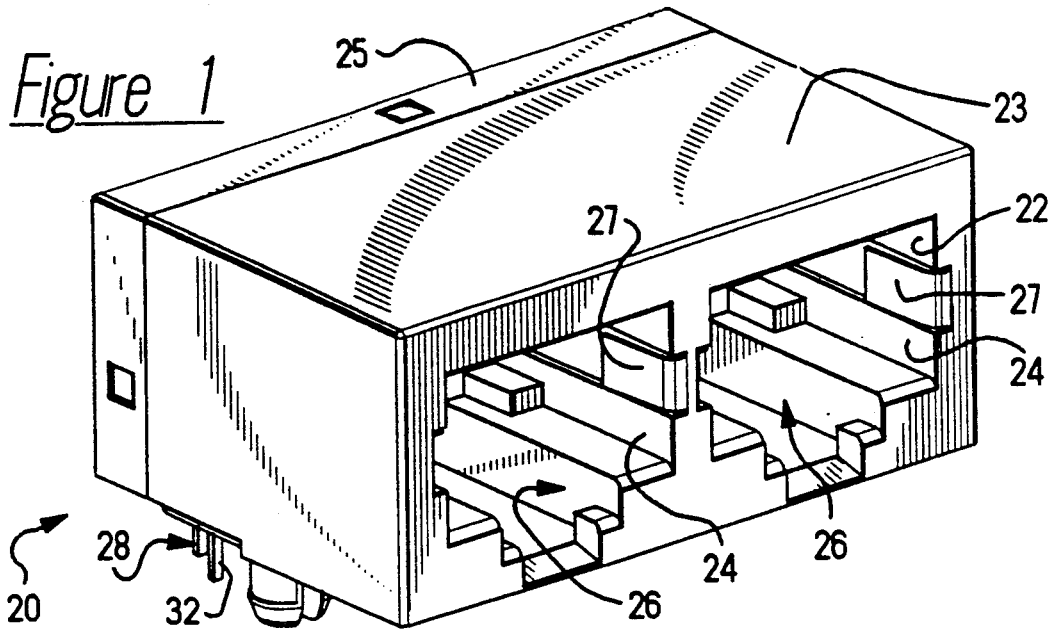
Figure 2
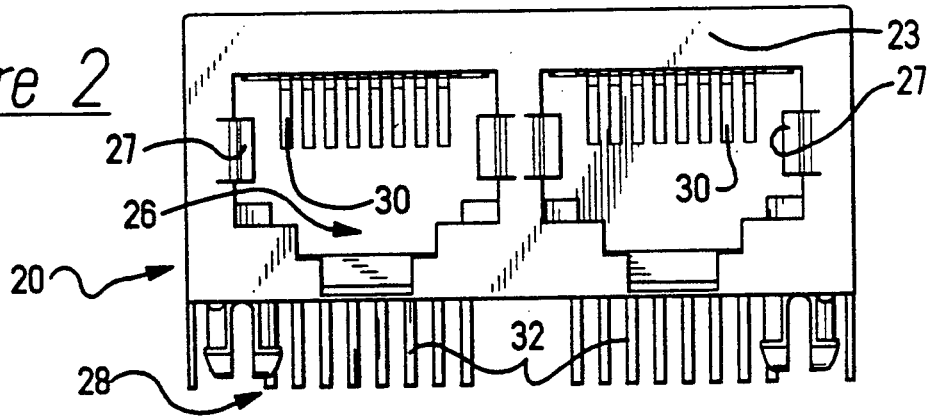
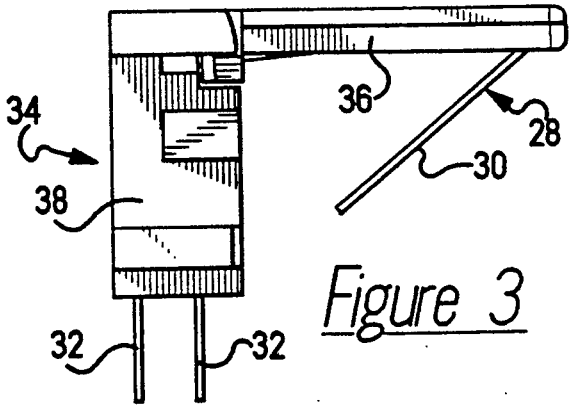
Figure 3

CONTACT ASSEMBLY AND METHOD FOR MAKING SAME

BACKGROUND OF THE INVENTION

This invention relates to an improved contact assembly of the type having an array of contacts which are held in position by at least one contact retaining element for insertion into a housing, and to a method for making such a contact assembly. Though not limited thereto, this invention has been applied successfully to contact assemblies for modular receptacles.

Modular receptacles are in widespread use, and there is an ongoing effort to provide lower cost, more reliable receptacles which can be assembled in a high speed, efficient manner. One approach of the prior art illustrated in Hughes U.S. Pat. No. 4,337,574 is to insert mold the housing for a modular receptacle around an array of contacts. This approach requires relatively complex insert molding equipment. Another approach which eliminates the need for insert molding equipment is illustrated in Hughes U.S. Pat. No. 4,292,736. In this approach, individual contacts are inserted into a premolded receptacle, as shown in FIGS. 7–9 of the Hughes '736 patent.

Another approach involves the use of a contact assembly which holds the preformed contacts in the desired alignment prior to assembly into a separate housing. For example, Abernethy U.S. Pat. No. 4,202,593 discloses one such contact assembly in which the contacts are wrapped around a generally U-shaped molded insulator. Paul U.S. Pat. No. 4,786,259, Dechelette U.S. Pat. No. 4,807,358, Nakazawa U.S. Pat. No. 4,699,595 and Abernethy U.S. Pat. No. 4,274,691 disclose other types of contact assemblies for modular receptacles. In each of these four patents, the contact assemblies include contact retaining elements which are one piece devices.

Johnston U.S. Pat. No. 4,817,283 discloses another contact assembly for a modular receptacle. In this assembly the contacts are held in position by a insulating element 74 which is molded in place across the contacts, and by two insulating plates 60, 62 which are assembled with the contacts to hold them in position.

The present invention is directed to an improved contact assembly which is reliable and inexpensive, which provides excellent true position for both ends of the contact, which is insertable with high speed, low cost assembly equipment at a very low reject level, and which can be formed with relatively simple insert molding equipment.

SUMMARY OF THE INVENTION

According to this invention, an electrical connector contact assembly includes a plurality of contacts and first and second insulating contact retaining elements. The contact retaining elements are engaged with the contacts to maintain the contacts in selected positions. Each of the contacts defines two exposed end portions and a central portion, and the end portions are each adapted to make contact with a respective external conductor. The central portions are disposed between the contact retaining elements and are bent such that the contact retaining elements are positioned at an angle with respect to one another. In the preferred embodiment described below, a latch on one of the contact retaining elements is configured to engage the other of the contact retaining elements to hold the contact retaining elements at the selected angle.

According to the method of the invention, first and second contact retaining elements are molded at respective positions around a plurality of substantially parallel contacts. Each of the contacts defines first and second end portions, each positioned adjacent to a respective one of the contact retaining elements and each adapted to make contact with a respective external conductor. Each of the contacts also defines a central portion located between the contact retaining elements. The central portions are then bent while moving the first and second contact retaining elements to a selected angle with respect to one another. Preferably, the first and second contact retaining elements are then latched together at the selected angle.

The contact assembly described below provides a stable assembly that holds both ends of the contacts in the desired positions in a stand alone device, and that does not require further bending or deformation when it is inserted into the housing. The contacts and the contact retaining elements cooperate to hold the array of contacts in a stable, preformed configuration prior to insertion into the housing. The method described below can be practiced with relatively simple insert molding and bending equipment, and this method provides a reliable and inexpensive fabrication method for contact arrays having excellent true positions of both ends of the contacts.

BRIEF DESCRIPTION OF THE DRAWING

FIG. 1 is a front perspective view of a modular receptacle in which is mounted a preferred embodiment of the contact assembly of this invention;

FIG. 2 is a front view of the receptacle of FIG. 1;

FIG. 3 is a side view of the preferred embodiment of the contact assembly of this invention;

DETAILED DESCRIPTION OF THE PREFERRED EMBODIMENTS

Figure 4:
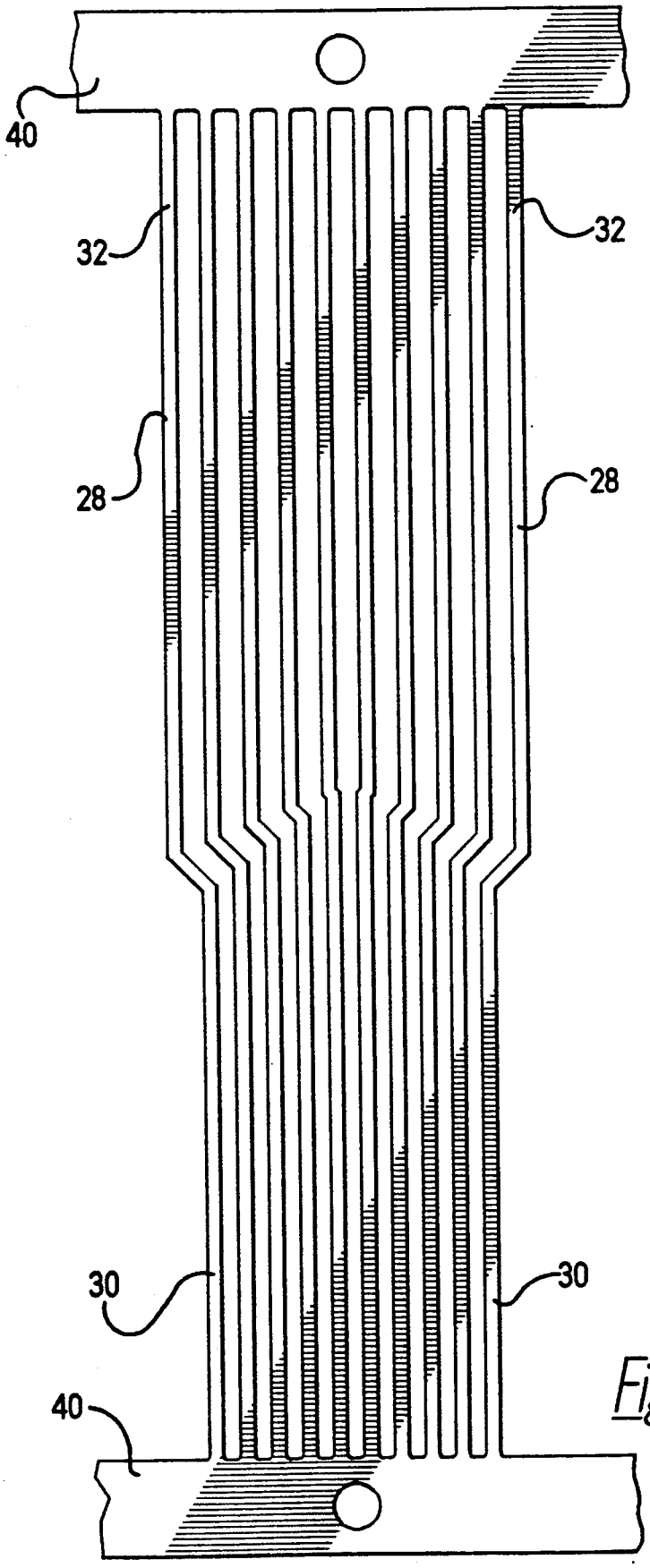
FIG. 4 is a plan view of a stamped contact array used in the fabrication of the contact assembly of FIG. 3.

Turning now the drawings, FIGS. 1 and 2 show two views of an electrical connector 20 which in this embodiment is a modular receptacle for two telephone type plugs. Though illustrated as a two port receptacle, it will of course be understood that the preferred embodiment described below can readily be used in a housing having any number of ports.

The receptacle 20 includes a housing 22 that defines sidewalls 24. Each pair of sidewalls 24 in turn defines a plug receiving cavity 26 that is shaped to receive a mating plug (not shown). Contacts 28 are mounted within the housing 22, and these contacts 28 each define first end portions 30 positioned to make contact with the mating plug (not shown) and second end portions 32 configured as solder tails and adapted to make contact with conductive traces on a printed circuit board (not shown).

As shown in FIGS. 1 and 2, the housing 22 is provided with a two part shield that can be made of a suitable sheet metal. The shield includes a front shield 23 that overlies the top, sides and front of the housing 22 and a rear shield 25 that overlaps the rear edge of the front shield 23 and overlies the rear of the housing 22. The front shield 23 defines spring fingers 27 shaped to make electrical contact with a mating plug (not shown). The front shield 23 may have a panel ground (not shown) as is known in the art, as disclosed for example in U.S. patent application Ser. No. 719,279 filed Jun. 21, 1991, entitled "Shielded Connector with Dual Cantilever Panel Grounding Beam, " which is hereby incorporated by reference, or U.S. Pat. No. 5,083,945, which is hereby incorporated by reference.

The contacts 28 are arranged in a contact assembly or insert 34 that includes first and second insulators 36, 38 that operate as contact retaining elements (FIG. 3). The following discussion will explain with FIGS. 4–12 the manner in which the insert 34 is formed, and then with FIGS. 13–15 the manner in which the insert 34 is assembled in the housing 22.

Turning now to FIGS. 4–12, the first step in the formation of the insert 34 is to stamp an array of contacts 28 such that they are held in position by opposed parallel carrier strips 40 (FIG. 4). As shown in FIG. 4 the contacts 28 define first ends 30 and second ends 32, and the spacing of the first ends 30 differs from that of the second ends 32.

Figure 5:
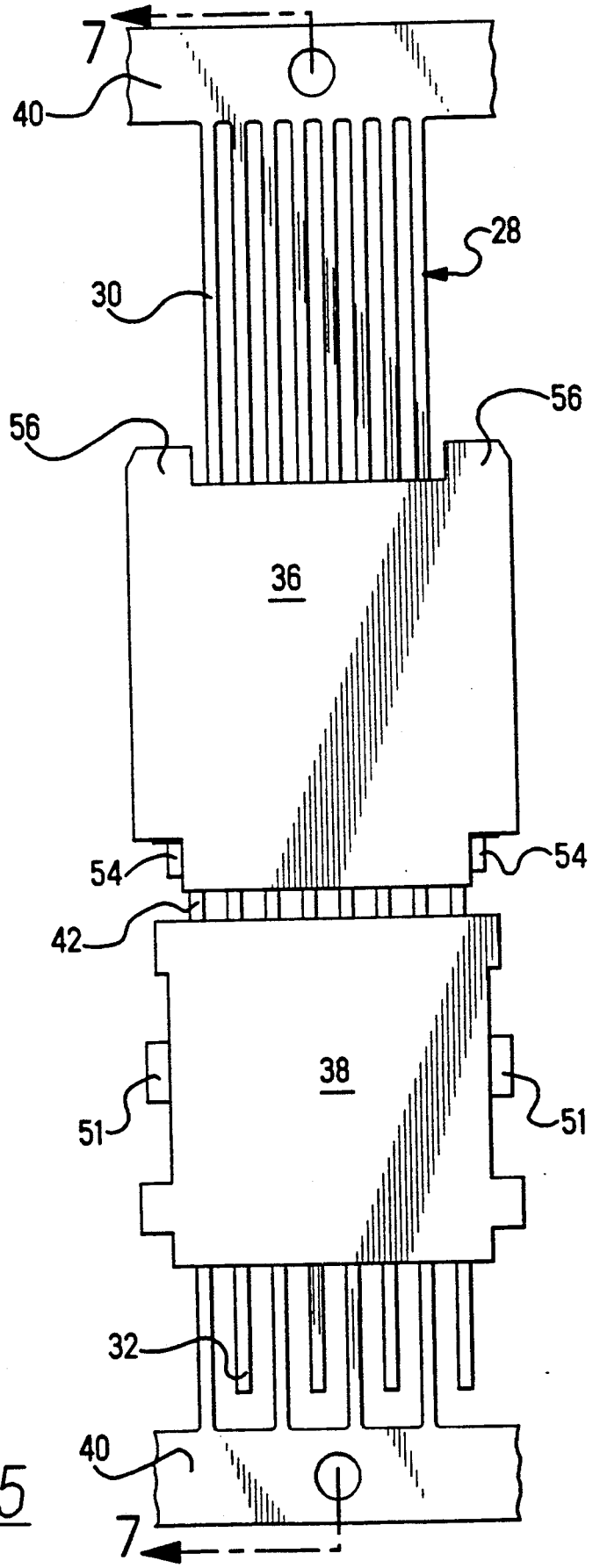
FIG. 5 is a top view taken at a first stage in the fabrication of the contact assembly of FIG. 3.
Figure 6:
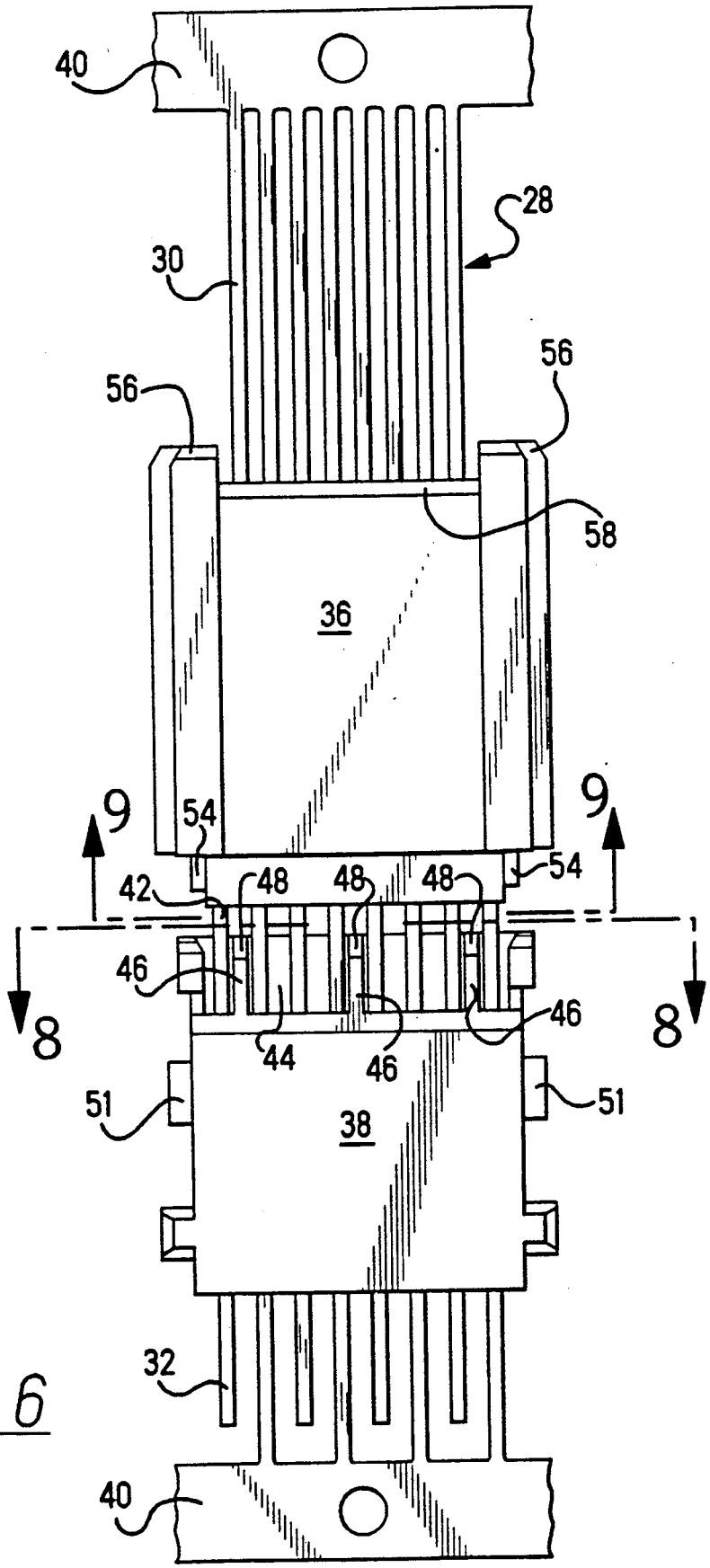
FIG. 6 is a bottom view of the elements of FIG. 5.
Figure 7:
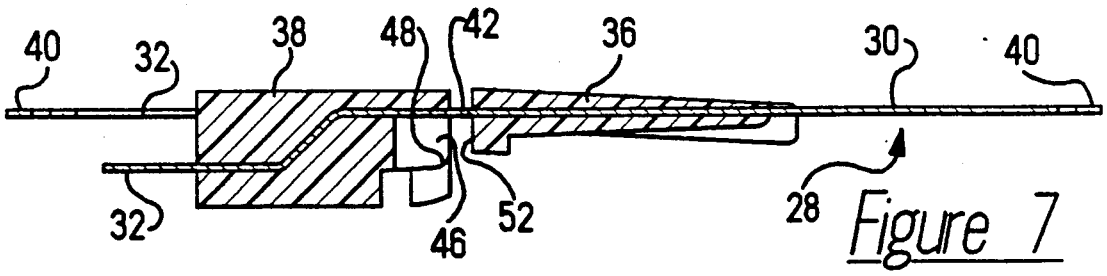
FIG. 7 is a longitudinal sectional view taken along line 7—7 of FIG. 6.

As shown in FIGS. 5–12, in the next step in the fabrication of the insert 34 first and second insulators 36, 38 are insert molded around the contacts 28. Prior to this insert molding operation half of the second end portions 32 are severed from the adjacent carrier strip 40 and bent to an offset configuration as shown in FIG. 7.

Figure 8:
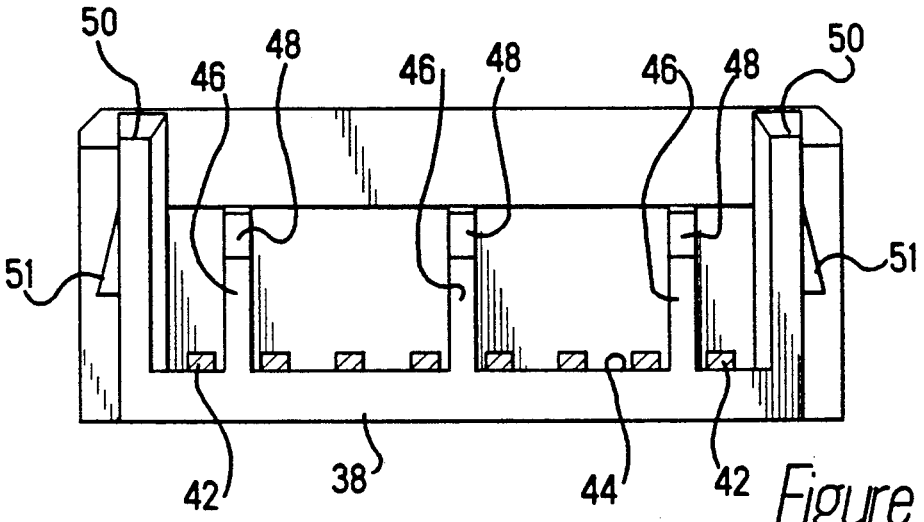
FIG. 8 is a cross-sectional view taken along line 8—8 of FIG. 6.
Figure 9:
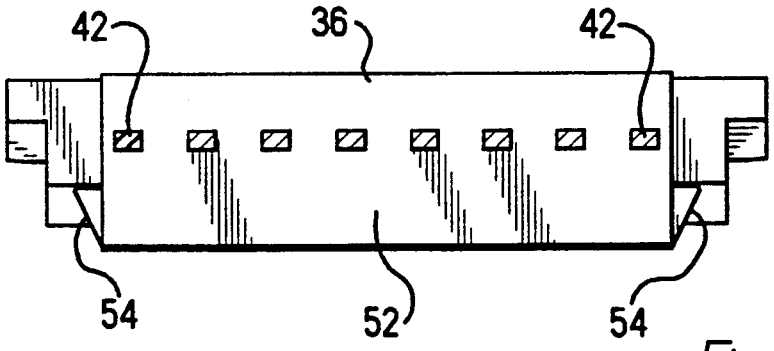
FIG. 9 is a cross-sectional view taken along line 9—9 of FIG. 6.
Figure 10:
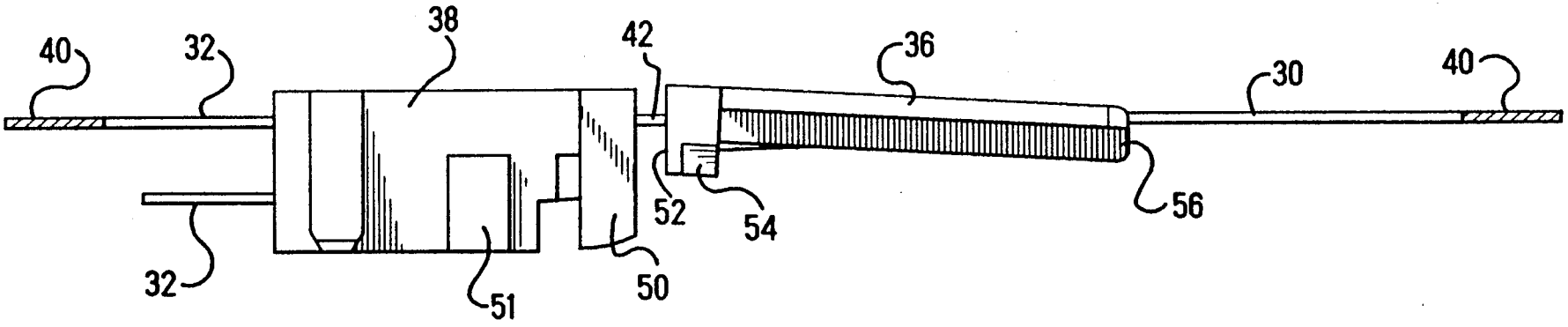
FIG. 10 is a side view taken along line 10—10 of FIG. 6.

A number of features of the insulators 36, 38 are important in the subsequent discussion. First, it should be noted that the insulators 36, 38 are separated from one another, and that a central portion 42 of the contacts 28 is exposed between the insulators 36, 38. This central portion 42 of each of the contacts 28 lies exposed but closely adjacent to an external surface 44 defined by the second insulator 38 (FIG. 8). As best shown in FIGS. 6 and 8, three ribs 46 are formed adjacent to the external surface 44, and each of these ribs 46 defines an arcuate bearing surface 48. In addition, the second insulator 38 defines a pair of flanges 50 at either end of the external surface 44. These flanges 50 are best shown in FIGS. 10 and 12. The second insulator 38 also defines a pair of wedges 51 on opposed side surfaces, as best shown in FIGS. 8, 11 and 12.

Turning now to the first insulator 36, this element defines a follower surface 52 (FIGS. 7, 9 and 12) which is designed to bear against the bearing surface 48 as described below. Also, the first insulator 36 defines a pair of latches 54, a pair of tabs 56, and a rounded edge 58 (FIGS. 5, 6 and 12). The tabs 56 provide a locating and a protecting function as described below.

Figure 11:
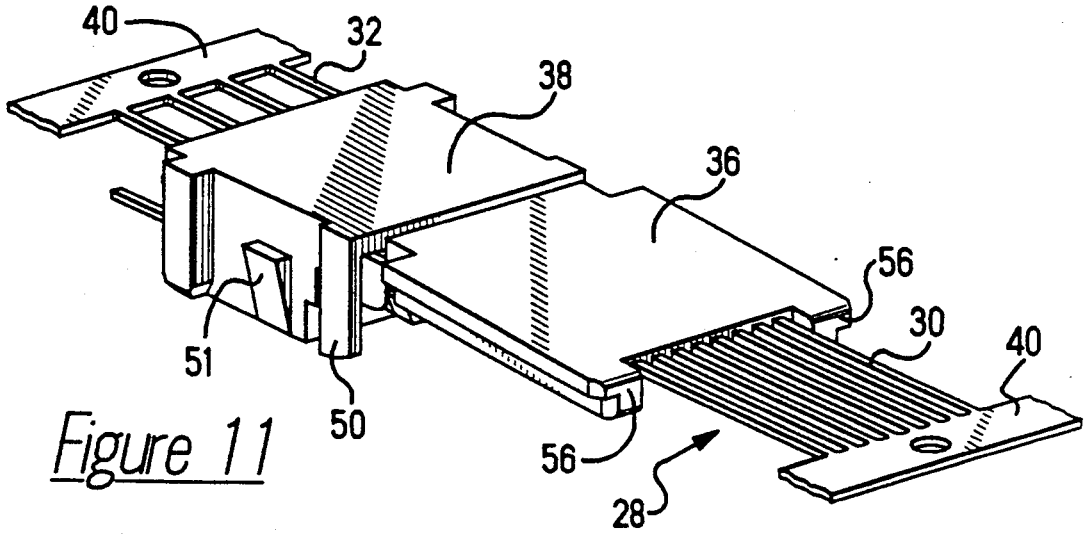
FIG. 11 is a top perspective view of the elements of FIG. 6.
Figure 12:
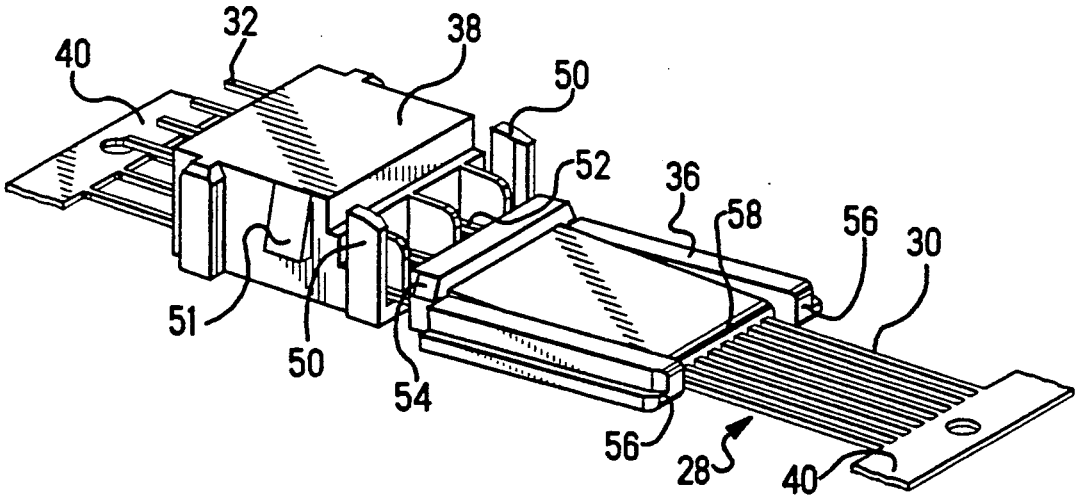
FIG. 12 is a bottom perspective view of the elements of FIG. 6.

As best shown for example in FIGS. 7, 11 and 12, the first and second insulators 36, 38 as initially formed are positioned in a substantially coplanar arrangement, as are the contacts 28. For this reason, the insulators 36, 38 can be formed using relatively small, inexpensive dies. In order to facilitate the bending operation described below the central portions 42 are preferably substantially coplanar (FIGS. 7-9) and completely exposed between the insulators 36, 38.

After the elements of FIGS. 4-12 have been formed as shown, the carrier strips 40 are then severed, and the first end portions 30 are bent around the rounded edge 58 to the position shown in FIG. 3. Then the first insulator 36 is rotated with respect to the second insulator 38 about a hinge axis defined by the central portions 42. This causes the central portions 42 to bend and to pull away from the external surface 44. During at least part of this bending operation the follower surface 52 rides along the arcuate bearing surface 48, thereby facilitating precisely repeatable bending of the central portions 42. As this bending operation nears completion, the latches 54 move into the region between the flanges 50 (see FIG. 12). Once the insulators 36, 38 have been moved to a position in which they are substantially transverse to each other, the latches 54 emerge below the flanges 50, thereby latching the first and second insulators 36, 38 at the desired 90° angle with respect to one another.

This completes the formation of the insert or contact assembly 34 of FIG. 3. Note that the first insulator 36 precisely positions the first end portions 30 immediately adjacent the rounded edge 58, and the second insulator 38 precisely positions the second end portions 32. The central portions 42 are bent to a selected angle of about 90°, and the bent central portions 42 provide a holding force that opposes the latches 54 and provides a stable assembly. In order to facilitate bending of the central portions 42, the central portions 42 are substantially coplanar adjacent their entry into both the first and second insulators 36, 38. The first end portions 30 are bent back toward the second insulator 38 to an acute angle as shown in FIG. 3.

Figure 13:
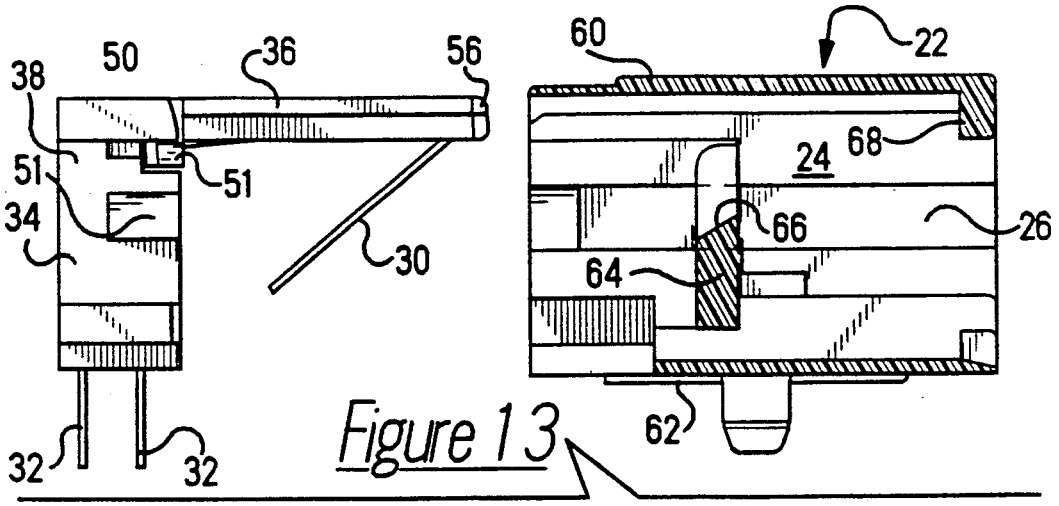
FIG. 13 is a side view in partial section of a first stage in the assembly of the contact assembly of FIG. 3 with a housing.
Figure 14:
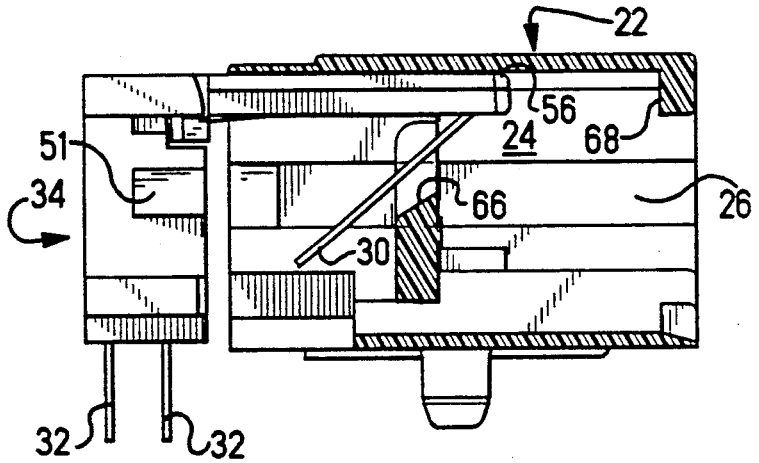
FIG. 14 is a view corresponding to FIG. 13 of a second, subsequent stage in the insertion of the contact assembly into the housing of FIG. 13.
Figure 15:
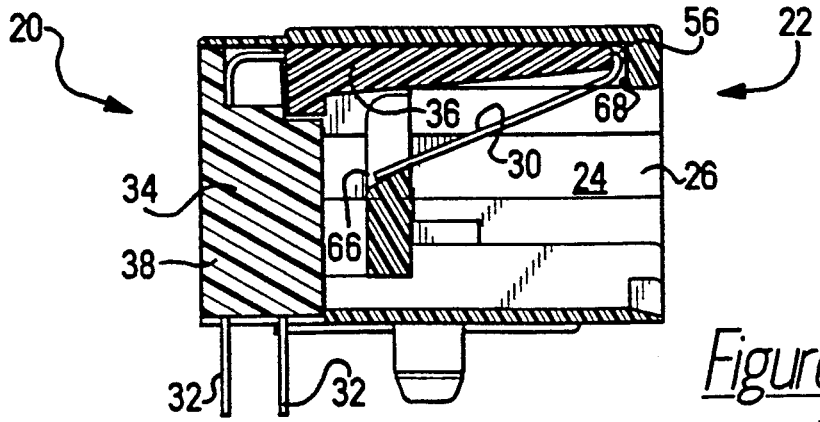
FIG. 15 is a cross-sectional view of the contact assembly of FIG. 3 fully inserted in the housing of FIGS. 13 and 14.

As shown in FIGS. 13–15, the insert 34 is assembled into the housing 22 by initially positioning the two elements as shown in FIG. 13. Note that the housing 22 defines a top wall 60, a bottom wall 62 and a cross bar 64 that extends between the sidewalls 24. The cross bar defines a sloped cam surface 66, and the top wall 60 defines a stop surface 68.

In the next stage of insertion shown in FIG. 14, the insert 34 is moved into the cavity 26 between the sidewalls 24. As shown in FIG. 15, when the insert 34 is fully inserted within the housing 22, the stop surface 68 contacts the tabs 56 to define a fully inserted position for the insert 34, and to protect the first end portions 30 from undesired contact with the housing 22. The cam surface 66 moves the first end portions 30 toward the first insulator 36 in order to ensure that the first end portions 30 are in a predetermined position within the housing 22. The insert 34 is held in its final position within the housing 22 by the wedges 51, which snap into mating recesses in the sidewalls 24. Adhesives, ultrasonic welding and other types of mechanical latches may be substituted for the wedges 51.

Simply by way of example and without intending to limit the scope of the following claims, it has been found that the following materials are suitable for use in this invention. The first and second insulators 36, 38 can be molded of a suitable thermoplastic material such as a polysulfone molding compound selected to provide low shrinkage and a suitably high degradation temperature to survive wave soldering. Contacts 28 can be formed of a suitable conducting material such as a spring tempered, cold rolled phosphor bronze.

The insert 34 can be used with a wide variety of housings, and thus it should be clear that this invention is not limited to housings with any specified number of plug receiving cavities 26. Furthermore, this invention is not limited to use with modular receptacles of the type illustrated, and it is not essential that the first and second insulators 36, 38 be formed as the physically separate pieces. If desired, they can be interconnected by a web, as long as this web is sufficiently thin and flexible to allow the insulators 36, 38 to be bent to the desired end position in which they are held by the latch 54.

From the foregoing, it should be apparent that a reliable and inexpensive method has been described for fabricating contact assemblies. These assemblies are completely preformed prior to insertion into the housing, and they therefore can be inserted at high speed using low cost assembly equipment with low reject levels. Because the contacts are fully retained in the insulators 36, 38, no bending or plastic deformation is required to hold the contacts in the housing. The insulators 36, 38 cooperate to provide excellent true position for both ends of the contacts. The low cost of the contact assembly 34 is enhanced by the fact that the contacts themselves are stamped in a relatively flat array and straight draw molds can be used to produce the insulators 36, 38.

The foregoing detailed description has been intended to illustrate one preferred form of this invention and not to limit its scope. The scope of the invention is defined by the following claims, including all equivalents.

I claim:

1. An electrical connector insert comprising:

a contact assembly comprising a plurality of contacts and first and second insulating contact retaining elements;

said contact retaining elements engaged with the contacts to maintain the contacts in selected positions, each of said contacts defining two exposed end portions and a central portion, said end portions each adapted to make contact with a respective external conductor;

said central portions disposed between the contact retaining elements and bent such that said contact retaining elements are positioned at an angle with respect to one another; and a latch on one of the contact retaining elements configured to engage the other of the contact retaining elements to hold the contact retaining elements at said angle.

2. The invention of claim 1 wherein the angle is about 90°.

3. The invention of claim 1 wherein the central portions of the contacts are positioned in a first plane adjacent the first contact retaining element and in a second plane adjacent the second contact retaining element.

4. The invention of claim 1 wherein the contacts in at least one of the contact retaining elements comprise first and second groups which emerge from said at least one of the contact retaining elements in respective planes adjacent to respective exposed end portions.

5. The invention of claim 1 further comprising an arcuate bearing surface on one of the contact retaining elements and a follower surface on the other of the contact retaining elements, said follower surface configured to move along the arcuate bearing surface as said contact retaining elements move from an initial position to a final position in which the latch holds said contact retaining elements at said angle, said follower and arcuate bearing surfaces effective to guide bending of the central portions as said contact retaining elements are moved from the initial to the final position.

6. The invention of claim 1 wherein the central portions are exposed and positioned closely adjacent to an external surface of one of the contact retaining elements when the contact retaining elements are in an initial position, and wherein the central portions pull away from the external surface as the contact retaining elements are moved to cause the latch to engage and hold the contact retaining elements at said angle.

7. The invention of claim 1 wherein said contacts provide a holding force oriented to hold the latch in engagement with the other of the contact retaining elements.

8. The invention of claim 1 wherein the exposed end portions adjacent one of the two contact retaining elements are bent at an acute angle to extend back toward the other of the two contact retaining elements.

9. The invention of claim 8 wherein said one of the two contact retaining elements defines extending tabs positioned to extend beyond the bent exposed end portions.

10. The invention of claim 1 in combination with a housing that receives the insert to form a modular receptacle that defines walls shaped to receive a mating plug.

11. The invention of claim 10 wherein the housing comprises a shield extending at least partially around the insert.

12. A modular receptacle comprising:

a housing which defines sidewalls configured to receive a mating modular plug;

a contact assembly received in the housing, said contact assembly comprising:

an array of substantially coplanar contacts, said contacts each defining a first exposed end positioned to mate with a mating plug, a second exposed end extending from the housing to mount to a printed circuit board, and a central portion which defines a bend of about 90°;

a first insulating contact retaining element molded around the array of contacts between the first ends and the central portions to hold the first ends in alignment; and a second insulating contact retaining element molded around the array of contacts between the second ends and the central portions to hold the second ends in alignment, wherein the first and second contact retaining elements are separated sufficiently to allow bending of the central portions of the contacts.

13. The invention of claim 12 wherein the central portions of the contacts are positioned in a first plane adjacent the first contact retaining element and in a second plane adjacent the second contact retaining element.

14. The invention of claim 12 wherein the contacts in at least one of the contact retaining elements comprise first and second groups which emerge from said at least one of the contact retaining elements in respective planes adjacent to respective exposed end portions.

15. The invention of claim 12 further comprising a latch mechanism operating between the contact retaining elements to hold the contact retaining elements in position substantially transverse to one another independently of the housing.

16. The invention of claim 15 further comprising an arcuate bearing surface on one of the contact retaining elements and a follower surface on the other of the contact retaining elements, said follower surface configured to move along the arcuate bearing surface as said contact retaining elements move from an initial position to a final position in which the latch mechanism holds the contact retaining elements in position, said arcuate bearing surface effective to guide bending of the central portions as said contact retaining elements are moved from the initial to the final position.

17. The invention of claim 15 wherein said contacts provide a holding force oriented to hold the latch mechanism in engagement.

18. The invention of claim 17 wherein the housing comprises a shield extending at least partially around the contact assembly.

19. A method for forming an electrical connector contact insert comprising the following steps:

a) molding first and second contact retaining elements at respective positions around a plurality of substantially parallel contacts, each of the contacts defining first and second end portions, each positioned adjacent to a respective one of the contact retaining elements and each adapted to make contact with a respective external conductor, each of the contacts also defining a central portion between the contact retaining elements.

b) bending the central portions of the contacts while moving the first and second contact retaining elements to a selected angle with respect to one another; and then c) latching the first and second contact retaining elements together at said selected angle to form said insert.

20. The method of claim 19 further comprising the step of bending the first end portions back toward the second contact retaining element.

21. The method of claim 19 further comprising the step of positioning the insert formed in the latching step (c) into a housing which defines walls shaped to receive a mating plug.

22. The method of claim 19 wherein the central portions are exposed and positioned closely adjacent to an external surface of one of the contact retaining elements when the contact retaining elements are molded in step (a), and wherein the bending step (b) causes the exposed central portions to pull away from the external surface.

23. The method of claim 19 wherein the contact retaining elements are molded in a substantially coplanar relationship in step (a), and wherein the bending step (b) orients the contact retaining elements substantially transversely to one another.

* * * * *